US005545274A

United States Patent [19]

Rosenthal

[11] Patent Number: 5,545,274

[45] Date of Patent: Aug. 13, 1996

[54] ARTIFICIAL FLOWER MAKING APPARATUS, METHOD OF MAKING THE SAME AND ARTIFICIAL FLOWER MADE THEREBY

[76] Inventor: Susannah Rosenthal, 606 Ardmore, Manhattan Beach, Calif. 90266

[21] Appl. No.: 236,363

[22] Filed: Apr. 29, 1994

[51] Int. Cl.[6] ..... A41G 1/02

[52] U.S. Cl. ..... 156/61; 156/204; 156/474; 428/24

[58] Field of Search ..... 428/4, 5, 24, 25, 428/26; 156/61, 474, 227, 204, 61; 206/575; 493/394

[56] References Cited

U.S. PATENT DOCUMENTS

| | | | |
|---|---|---|---|
| 2,062,276 | 11/1936 | Burton | 428/26 X |
| 3,565,736 | 2/1971 | Jason | 428/26 |
| 3,637,455 | 1/1972 | Pearson et al. | 428/4 |
| 3,780,514 | 12/1973 | Rodermund et al. | 428/4 |
| 3,859,897 | 1/1975 | Higa | 493/394 X |
| 4,449,652 | 5/1984 | Coppins et al. | 428/4 X |
| 4,550,038 | 10/1985 | Becker et al. | 428/12 |
| 5,108,800 | 4/1992 | Koo | 428/26 |
| 5,145,730 | 9/1992 | Cheng | 428/24 |
| 5,240,526 | 8/1993 | Koo | 428/26 X |
| 5,300,010 | 4/1994 | Eddins | 428/26 X |

*Primary Examiner*—Henry F. Epstein
*Attorney, Agent, or Firm*—Blakely Sokoloff Taylor & Zafman

[57] ABSTRACT

A toy flower maker is made of two flat adjacent plates, a roller disposed through one plate and engaging the second plate, and a slot disposed near the bottom for insertion and retention of a tie for tying the toy flower after it is made. In operation, a flexible paper is placed in between the plates and adjacent the roller; the roller is rotated to transport the paper toward the end of the plates, where the paper engages the tie inserted into the slot. When the sheet is substantially transported past the roller, the tie is secured around the sheet, and the edges of the paper are spread radially outward, forming the toy flower.

9 Claims, 7 Drawing Sheets

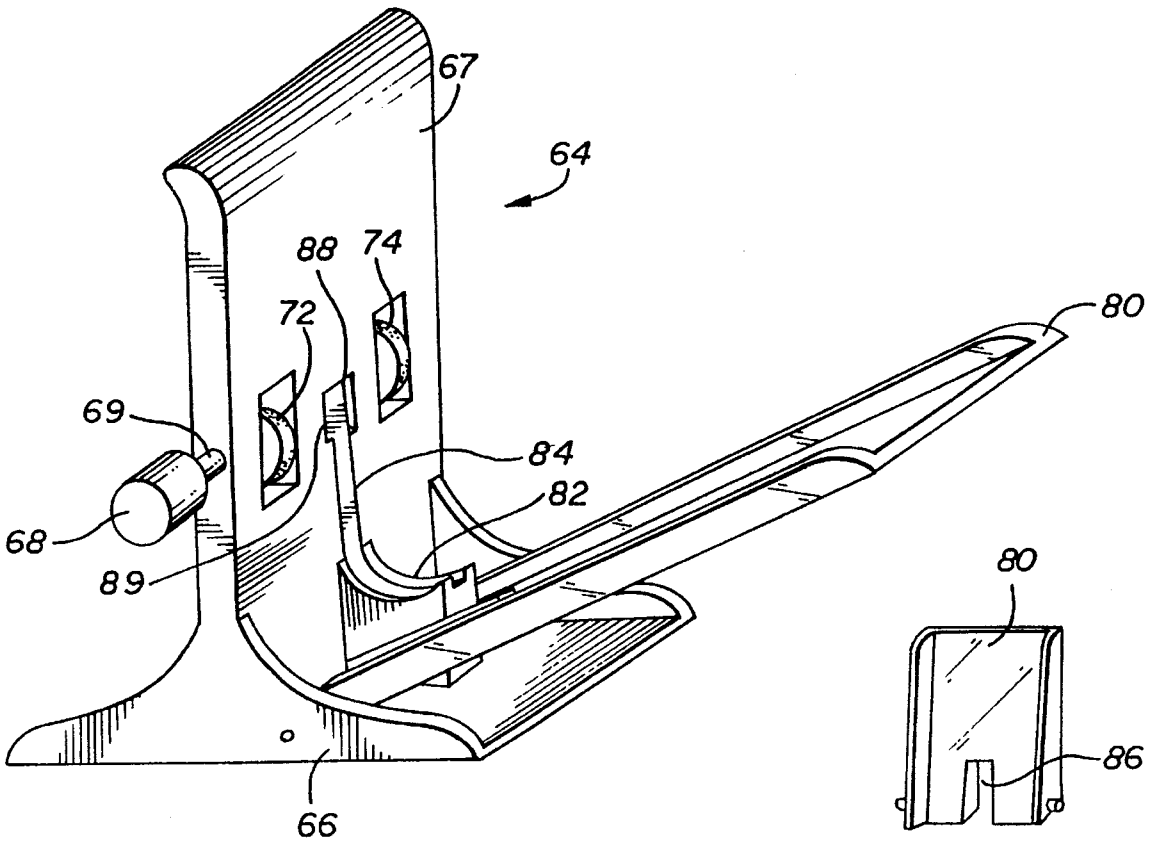
FIG. 9a
FIG. 9
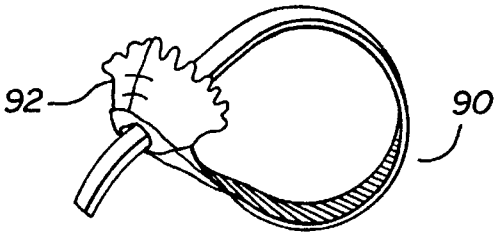
FIG. 10

ARTIFICIAL FLOWER MAKING APPARATUS, METHOD OF MAKING THE SAME AND ARTIFICIAL FLOWER MADE THEREBY

BACKGROUND OF THE INVENTION

1. Field of the Invention

The present invention is directed to the field of artificial flowers, and more particularly, is directed to an artificial flower, an apparatus for making artificial flowers, and a method for making artificial flowers using the invented apparatus.

2. Background of the Invention

Children enjoy playing with toys, and toys which enhance artistic skills and appreciation in children are particularly beneficial. Children often also enjoy flowers because of their natural beauty and vivid color. Artistic endeavors which allow children and others to create flowers are perceived to be of great benefit, and are anticipated to create positive stimulation and interest.

There have been extensive efforts to accurately create artificial flowers which simulate real flowers. Such artificial flowers are generally constructed with fabric petals, in which the pieces of fabric used to simulate the petals are molded to a suitable shape, and are colored and/or printed to provide an accurate visual appearance. Generally, a woven polyester fabric is used for the fabric, although other materials or synthetic yarns can also be used. Further, the fabric may be sized with a stiffening agent to help retain the fabric in its molded shape.

U.S. Pat. Nos. 5,108,800 and 5,240,526 are directed to a method of making artificial flowers, and the artificial flowers made by heating the tips of the petals to a temperature sufficient to melt the fabric in the region of the tips while protecting the petals in areas thereof other than the tips to prevent melting thereof and as a result, a shriveled, dried-up appearance is imparted to the artificial flower.

It would thus be advantageous to provide an apparatus which makes artificial flowers, and would be particularly advantageous to provide an apparatus which is simple enough to use as a toy, and as an educational device, to permit children to make artificial flowers.

SUMMARY OF THE INVENTION

The present invention is directed to an apparatus for making artificial flowers. The present invention is also directed to a method of making artificial flowers. Additionally, the present invention is directed to an artificial flower made in accordance with the present invention. The apparatus described herein may be considered a toy to permit young children and the like to make artificial flowers.

The apparatus of the present invention includes a pair of parallel and adjacent plates with a roller means disposed in at least one of the plates. The plates are hinged together at or near the bottom so that they can be separated and then replaced in an adjacent relationship. When the plates are disposed in an adjacent relationship, they are loosely together or slightly apart, so that a sheet of material has sufficient room to travel through the space between the plates and be slightly bunched together near the bottom. The rollers are disposed through slots in one of the plates, and the surface of the rollers abuts the other of the plates. A slot is provided through both plates to accommodate a fie means which will be described in more detail below. The slot is preferably large through the back plate, and small through the front plate, or visa versa, so that an end of the tie means is locked in one plate, and there is sufficient space in the other plate that the other end of the tie can be passed around the sheet used to make the flower. The rollers are preferably disposed adjacent the slot in which the tie can be disposed so that the sheet used to make the flower is bunched slightly below the level of the rollers.

The tie is preferably a plastic wire tie of the type commercially available through electronics stores and is used to gather together and retain wires and the like. The tie is generally made of plastic with a small receiving head with a slot at one end for receiving the other end to form a loop which can be tightened.

The sheet used to make the flower can be any thin, generally rectangular piece of paper or plastic, and is preferably a plastic sheet, and most preferably a mylar sheet, of appropriate size to fit in the apparatus of the present invention.

In use, first the door is opened and an end of the tie is inserted into the slot for holding it in the apparatus. Next the sheet is inserted and the door is closed. The sheet is advanced and the roller is rotated until the sheet is past the roller, and past the end of the tie disposed in the slot of the apparatus. The other end of the tie is looped around the compressed paper and inserted into the slot in the tie and the loop is tightened. The resulting artificial flower is then removed, and its artificial pedals may be spread and arrange for aesthetic enhancement, as desired by the user.

The flower of the present invention is comprised of a flexible and resilient stem portion, such as a plastic, and a sheet of material which is regularly or irregularly compressed in one direction, the flexible stem portion being wrapped around the middle of the compressed sheet and secured thereto, and the compressed material, after being secured by the stem portion, being spread radially outward to form a generally circular cross-section.

BRIEF DESCRIPTION OF THE DRAWINGS

FIG. 9 is an exploded view of an alternative embodiment of the present invention.

FIG. 9*a* is a front view of the door of the present invention.

FIG. 10 an alternative embodiment of the tie of the present invention.

DETAILED DESCRIPTION OF THE INVENTION

The present invention is shown in FIGS. 1–8 in a first embodiment, and a second embodiment and variation are shown in FIGS. 9 and 10. As described below, FIGS. 1–8 depict the apparatus of the present invention, the method of making the apparatus and the flower made using the apparatus of the present invention.

Figure 1:
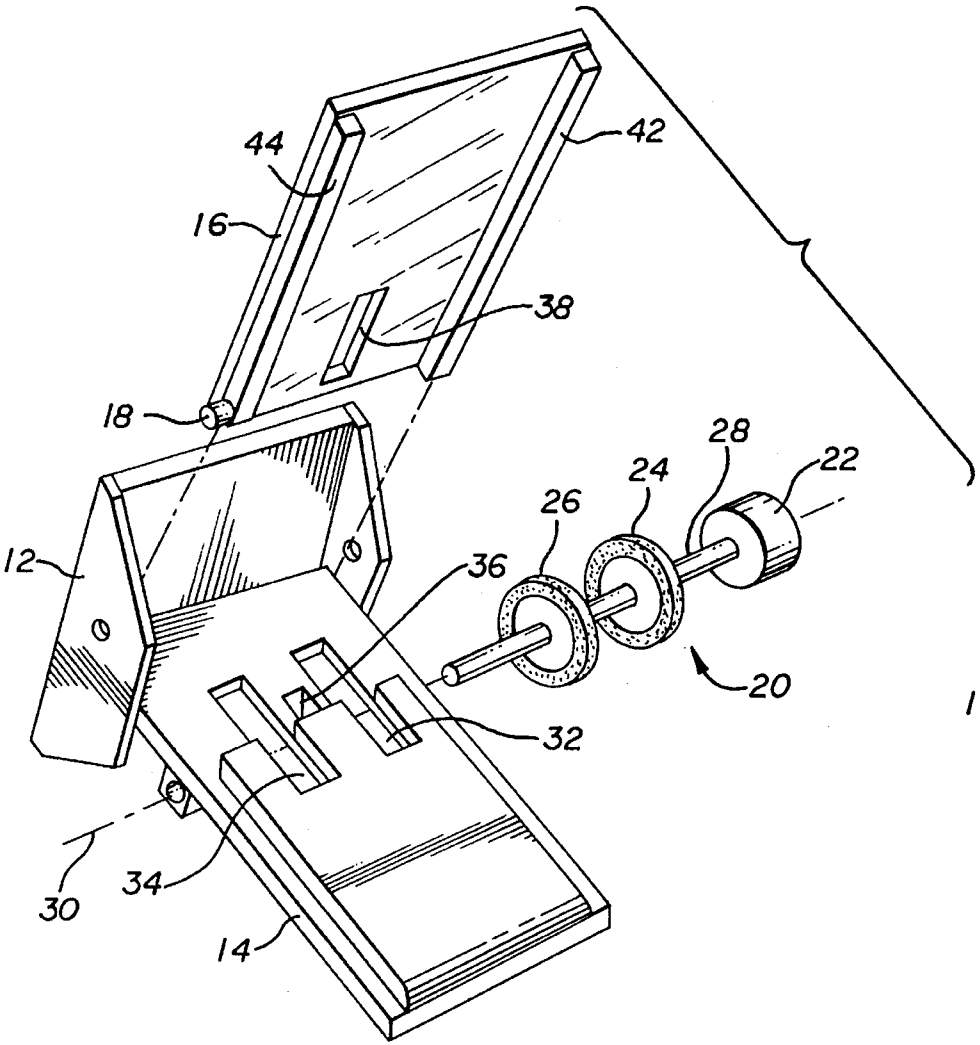
FIG. 1 is a perspective exploded view of the flower making apparatus of the present invention.

As shown in FIG. 1, the apparatus of the present invention comprises a base member 12 with a fixed plate 14 and a movable plate or door 16 connected to the base member by a hinge comprising a pin 18 disposed in a hole 19 on each of two opposite sides of the plate (only 1 is shown in FIG. 1) so that it can rotate from an open to a dosed position. The plates are preferably, but not necessarily, transparent or translucent so that the progress of the sheet making the petals of the artificial flower can be observed. Alternatively, a window can be provided in one or both plates for the same purpose. While the apparatus is shown on its side for easy viewing, it will be understood that it can operate in any position, but that typically, the base member 12 will be disposed on a flat surface, such as a table. A roller assembly 20 is shown in exploded view, as is the door 16. The roller assembly comprises a knob 22, first and second rollers 24 and 26, respectively, and an axle 28. The axle 28 is disposed through hole 30 in the fixed plate 14. It will be understood that the roller assembly can be installed in either of the plates, 14 or 16, without departing from the spirit and scope of the invention. The rollers 24 and 26 are aligned to fit through slots 32 and 34, and arrange to abut against door 16 when it is closed. Slot 36 holds the head of the tie, when installed and described below, and slot 38 allows the tie to pass through. Margin members 42 and 44 control the direction of the sheets which make the petals, as described below.

Figure 2:
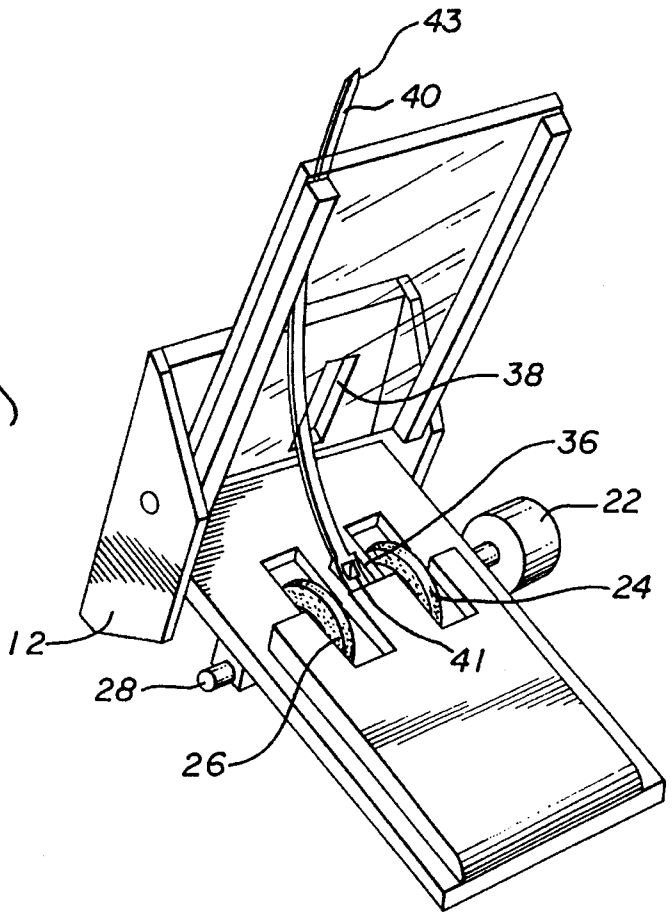
FIG. 2 is a perspective view of the flower making apparatus of the present invention with a stem portion installed therein.

As shown in FIG. 2, a tie 40 is disposed in the apparatus for making flowers. The tie is disposed so that the head 41 of the tie is disposed in the slot 36 and the body of the tie is disposed through slot 38. The head 41 of the tie has a one-way flange or connector which allows the end 43 of the tie to pass through, but grabs the body of the tie preventing it from being pulled out of the head.

Figure 3:
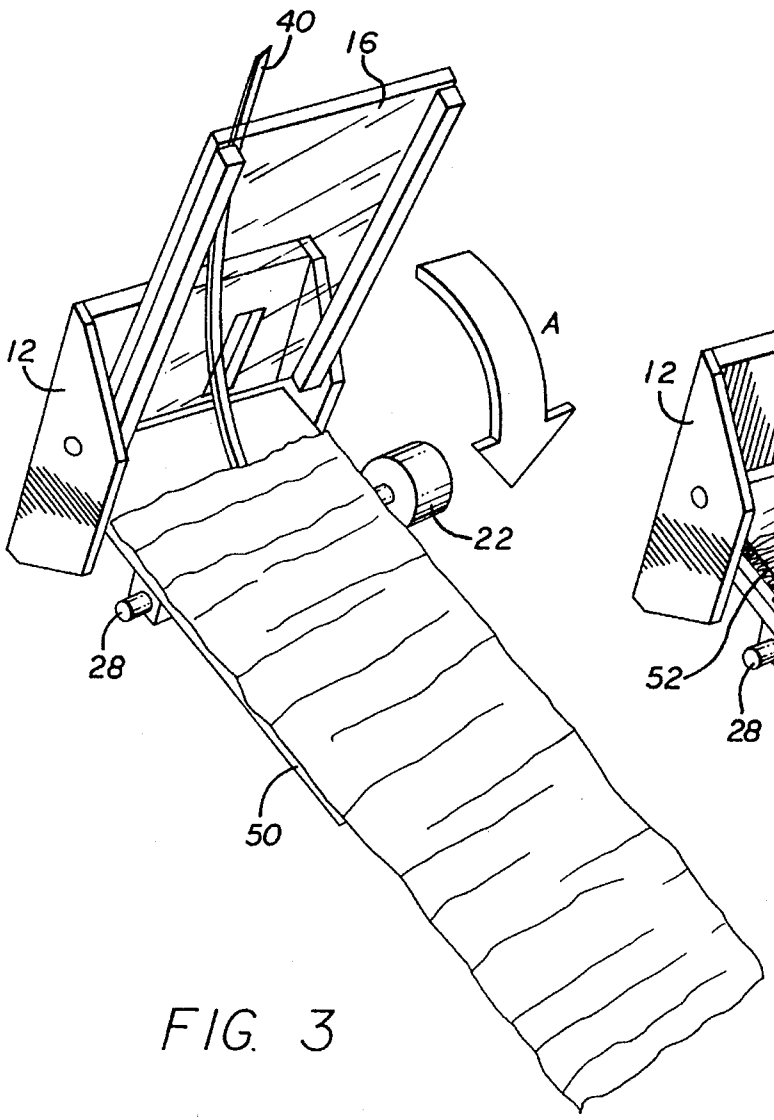
FIG. 3 is a perspective view of the flower making apparatus of the present invention with a stem portion and a flower petal sheet installed therein.

As shown in FIG. 3, a sheet of material 50 is disposed within the apparatus of the present invention. The material may be any thin, relatively flexible and resilient paper or plastic, or the like, and preferably is a thin gauge plastic, preferably made of decorative colors or designs. The length is preferably at least as long as its width, and can be longer, as shown in FIG. 3. The tie 40 is still disposed in the apparatus and becomes the stop for the material 50 so that it becomes compressed. The arrow A depicts the door 16 being closed over the material 50 to capture it between the door 16 and the plate 14.

Figure 4:
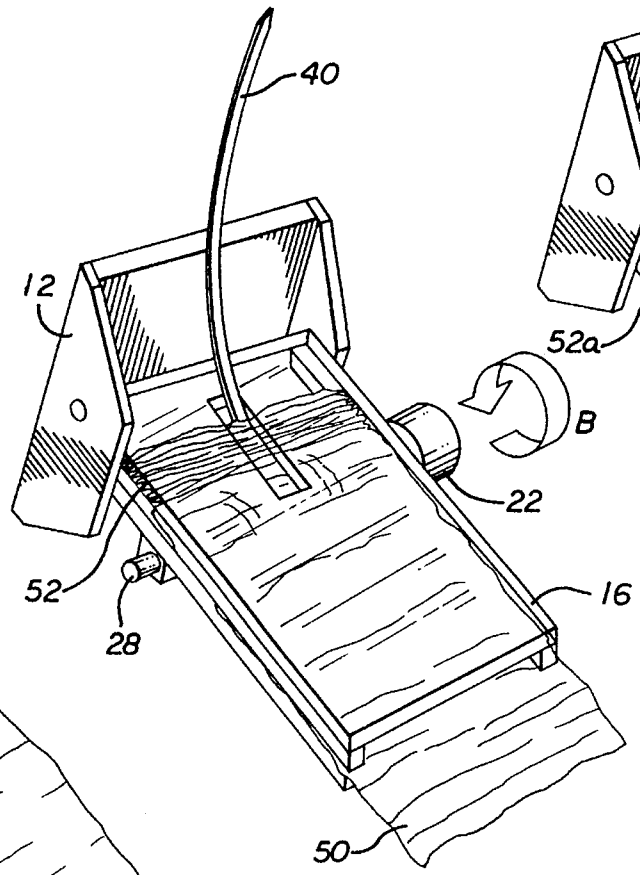
FIG. 4 is a perspective view of the flower making apparatus of the present invention with a stem portion and a flower petal sheet installed therein, the plates of the apparatus being closed and the rollers being partially rotated.

As shown in FIG. 4, the door 16 is closed capturing the sheet 50 loosely enough that it can slide between the door 16 and the plate 14. When the knob 22 is rotated in direction B as shown, the sheet 50 is transported toward the base 12, and its motion is stopped by the tie 40 which blocks its travel in the space between the plates. As the sheet 50 is advanced it forms a compressed sheet 52.

Figure 5:
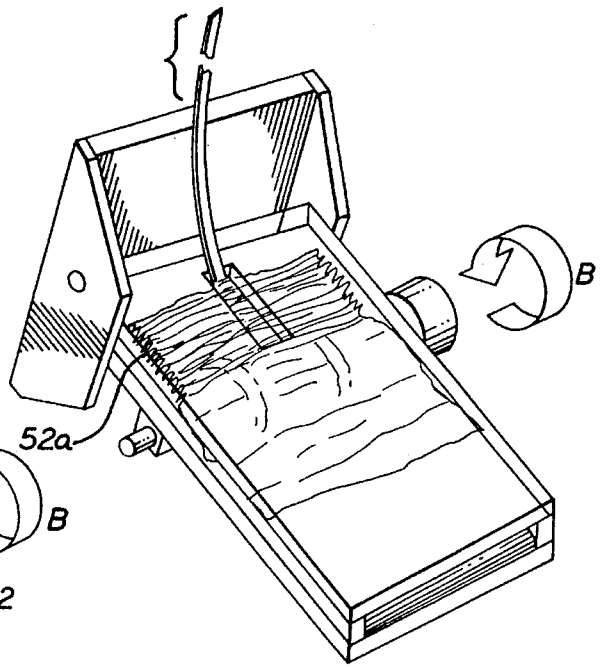
FIG. 5 is a perspective view of the flower making apparatus of the present invention with a stem portion and a flower petal sheet installed therein, the plates of the apparatus being closed as shown in FIG. 4, with the rollers being partially rotated further than as shown in FIG. 4.

As shown in FIG. 5, as the knob 22 continues to be rotated, the sheet 50 continues to be transported toward the base 12 by the rollers, and the compressed sheet 52*a* continues to grow and the rest of the sheet shrinks in length. FIG. 5 illustrates that there is a small gap in between the plates 14 and 16.

Figure 6:
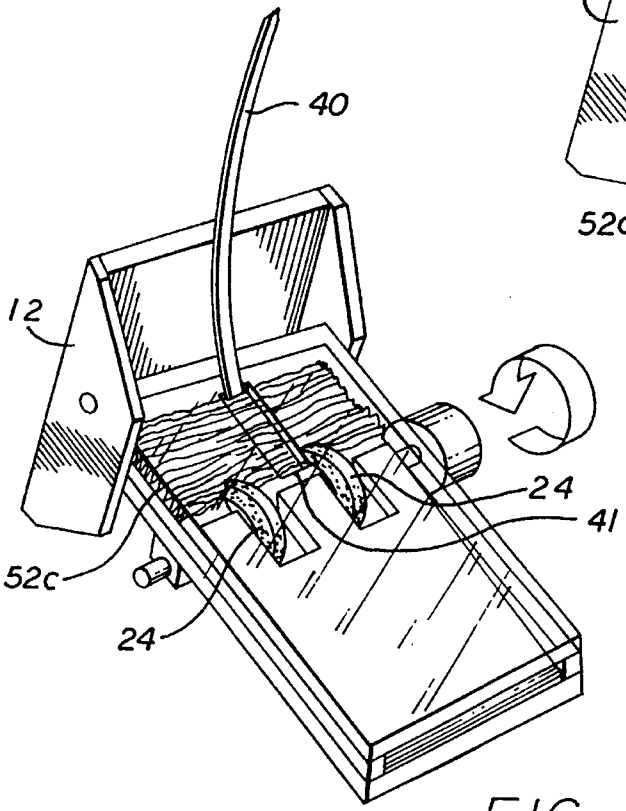
FIG. 6 is a perspective view of the flower making apparatus of the present invention with a stem portion and a flower petal sheet installed therein, the plates of the apparatus being dosed as shown in FIG. 4, with the rotation of the rollers completed and the petal sheet being fully compressed.

Next, as shown in FIG. 6, the entire sheet is a compressed sheet 52*c* as the end of the sheet is passed through the rollers 24 and 26, and exposing the end 41 of the tie 40 disposed in the slot 36.

Figure 7:
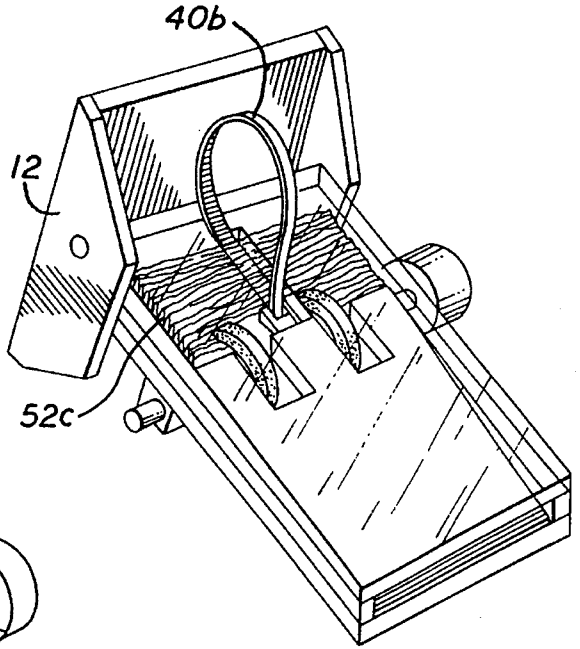
FIG. 7 is a perspective view of the flower making apparatus of the present invention as shown in FIG. 6, and showing the stem being looped through the head of the plastic tie.

As shown in FIG. 7, the tie 40*b* is wrapped around the compressed sheet 52*c*. The end 43 of the tie 40*b* is passed through the head 41 and is tightened into a small loop which tightly retains the compressed sheet 52*c*.

Figure 8:
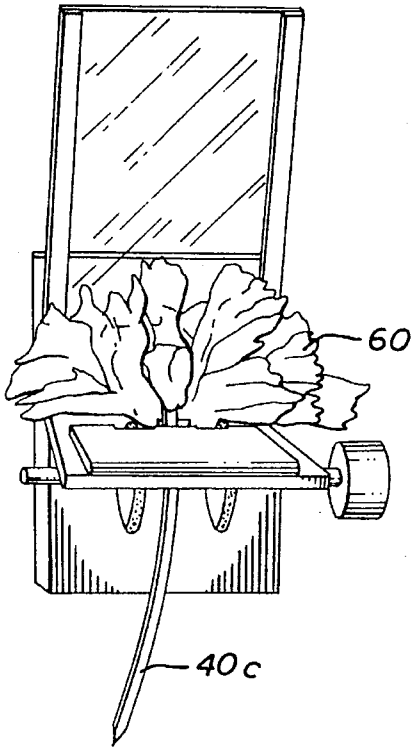
FIG. 8 is a front view of the flower making apparatus of the present invention with the door open and the flower disposed in the apparatus.

Finally, as shown in FIG. 8, the end 43 is pulled completely through the head 41 (not shown) into a fight loop. The sheet is held by the loop in the center, and the artificial flower 60 is formed. As shown, the door 16 is raised allowing the sheet to expand out to give the appearance of petals of a flower.

In another embodiment of the present invention shown in FIGS. 9 and 9*a*, the apparatus 64 for making a flower comprises a base member 66 having a roller 67 disposed there in, the roller comprising a knob 68 attached to an axle 69 and two roller wheels 72 and 74 disposed thereon in slots. A door 80 is hingedly attached to the base member 66. A tie holder 82 is disposed at the bottom of the apparatus 64 which curves the tie 84 around and directs it upward and eventually out of the slot 86 (FIG. 9*a*). As in the first described embodiment, the head 88 of the tie 84 is disposed in the slot 89 and held in place there until the end of the tie is looped around the compressed material and inserted into the head of the tie.

FIG. 10 discloses an alternative embodiment of a tie 90 in which the head 92 comprises a decorative shape which takes on the appearance of a base of a flower.

Figure 11:
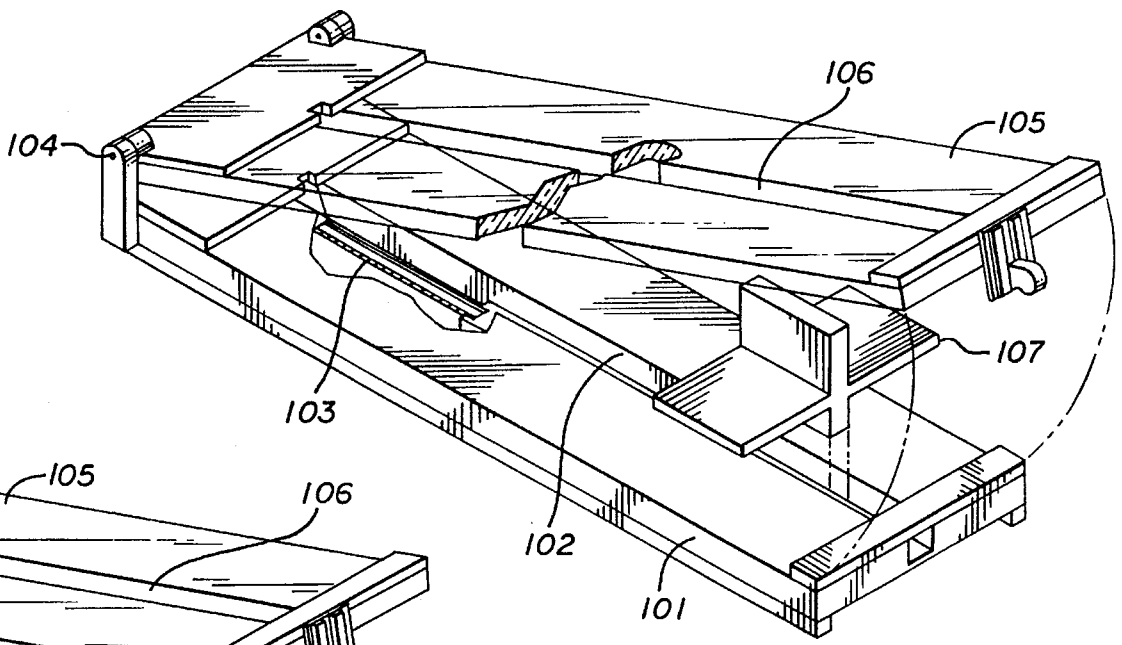
FIG. 11 is a perspective view of a second alternative embodiment of the flower making apparatus of the present invention.

As shown in FIG. 11, the apparatus of the second alternative embodiment of the present invention comprises a base member 101 with a slot 102 running along the length of the base member, which has a recessed area 103 on one end of the slot. Attached to the base member 101 by a hinge comprising a pin disposed in a hole 104 on each of two opposite sides of the base is a plate 105, with a slot 106 running along the length of the plate. Inserted into the slots of the plate 105 and the base member 101 is a T-shaped, paper compressing block 107. The plate is preferably, but not necessarily, transparent so that the petal sheet can be observed as the paper compressing block 107 engages it.

Figure 12:
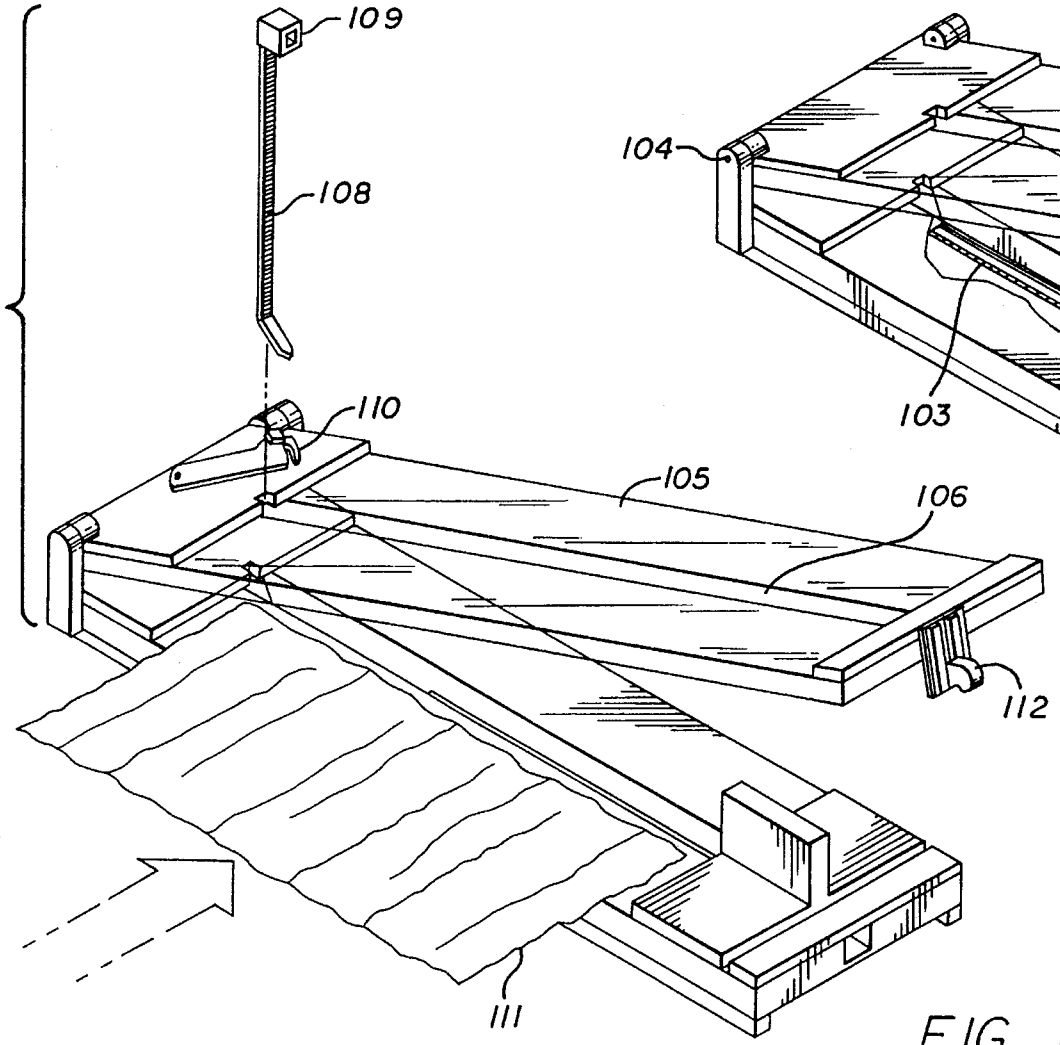
FIG. 12 is a perspective view of a second alternative embodiment of the flower making apparatus showing the installation of the stem portion and flower petal sheet.

As shown in FIG. 12, a tie 108 is inserted through the end of slot 106 in plate 105, so that its length is disposed at the bottom of the recessed area 103 in slot 102 of base member 101. The head of the tie is secured in place by the hook 110 which is attached to the plate 105. Between the plate 105 and the base member 101, and in front of the paper compressing block 107, is placed a petal sheet 111. The plate 105 is lowered onto the petal sheet 111, and locked into place by the latch 112.

Figure 13:
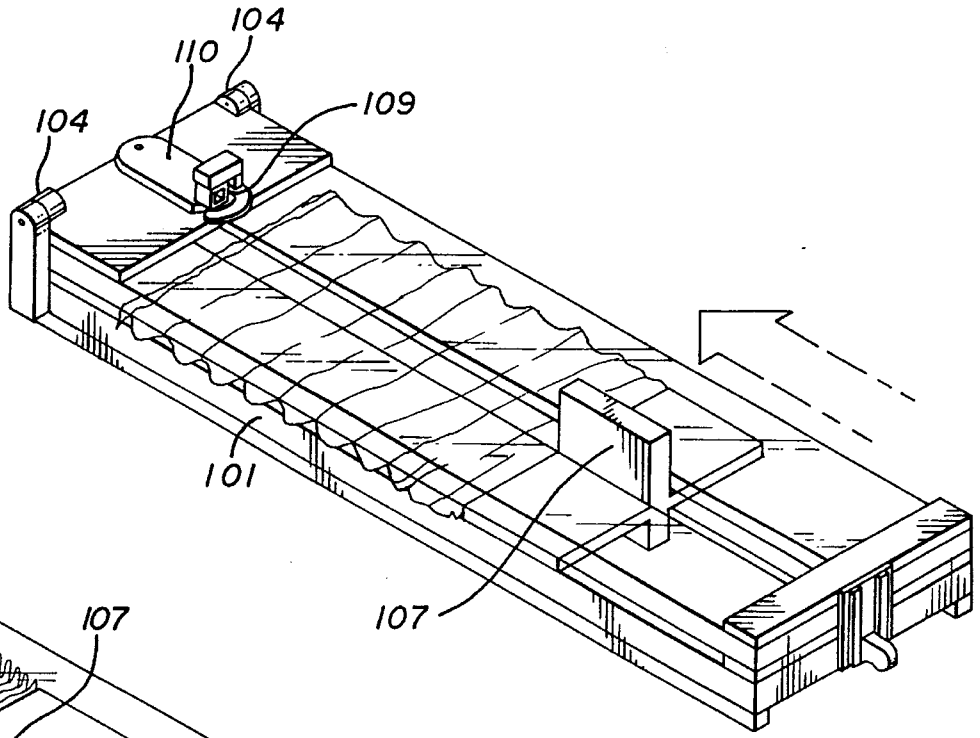
FIG. 13 is a perspective view of a second alternative embodiment of the flower making apparatus with a stem portion and petal sheet installed therein, the plates of the apparatus being dosed and the paper compressing block being partially moved forward.

As shown in FIG. 13, the paper compressing block 107 is moved forward to compress and fold the petal sheet in the direction of the hinge end 104 of the base member 101.

Figure 14:
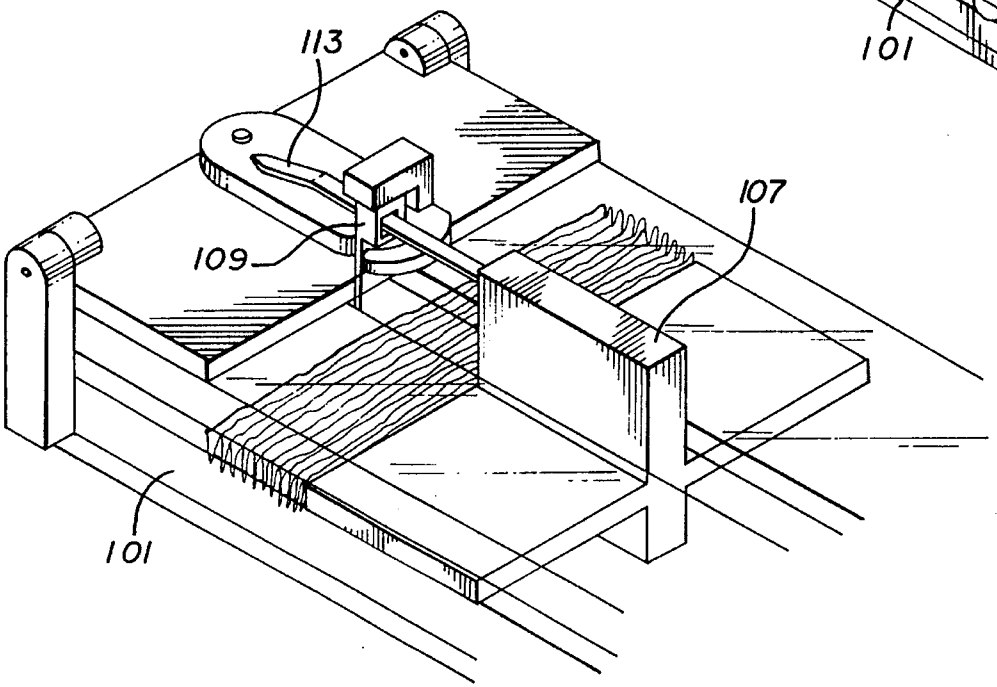
FIG. 14 is a perspective view of a second alternative embodiment of the flower making apparatus with a stem portion and flower petal sheet installed therein, the plates of the apparatus being closed as in FIG. 11, with paper compressing block being moved completely forward, the petal sheet being completely compressed, and the stem being looped through the head of the plastic tie.

As shown in FIG. 14, the paper compressing block 107 has engaged the tie end lying in the recessed area 103 of the slot 102. The tie 108 has been looped around the petal sheet by the paper compressing block 107, and the tie end 113 has been inserted through the tie head 109.

Figures 15, 16, 17:
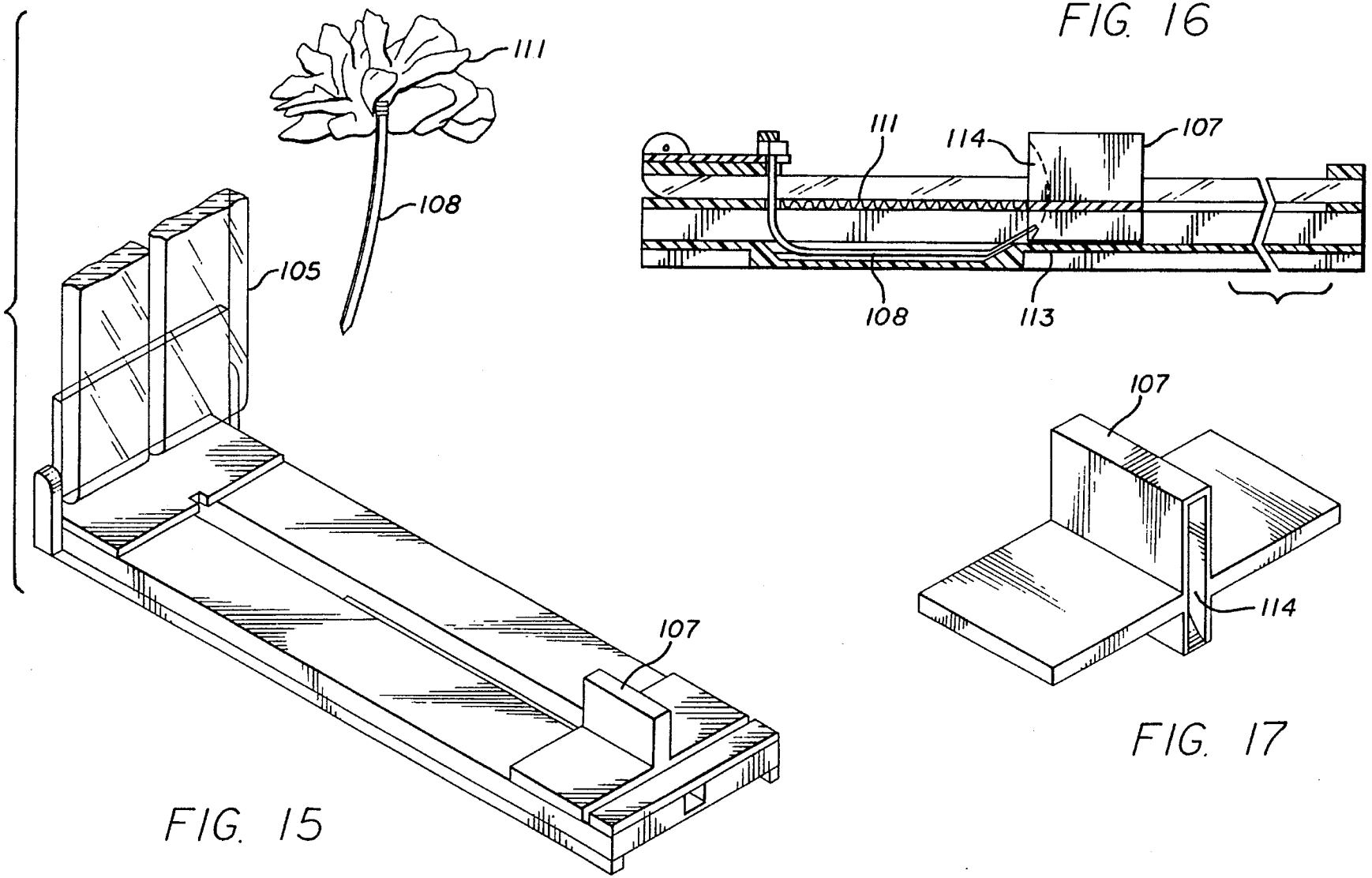
FIG. 15 is a perspective view of a second alternative embodiment of the flower making apparatus with the top plate opened and the finished flower removed from the apparatus.
FIG. 16 is a side view of a second alternative embodiment of the flower making apparatus with a stem portion and petal sheet installed therein, the plates of the apparatus being closed and the paper compressing block being partially moved forward to where the concave slot in the front of the paper compressing block contacts the end of the stem section.
FIG. 17 is a perspective view of the paper compressing block showing the concave slot in the front of the paper compressing block.

As shown in FIG. 15, the paper compressing block 107 has been returned to its starting position, the plate 105 has been opened, and the finished flower comprising the tie 108 and petal sheet 111 has been removed from the flower making apparatus.

As shown in FIG. 16, is a side view of the alternative flower making apparatus showing how the concave slot 114 of the paper compressing block 107 engages the tie end 113 and loops the tie 108 around the petal paper 111, as the paper compressing block 107 compresses and folds the petal paper 111.

As shown in FIG. 17, the T-shaped compressing block 107 has a concave slot 114 end for engaging the end of the tie 113 as it lays in the recessed area of the slot 103 in the base 101.

It will be understood by person of ordinary skill in the art that many changes, additions, deletions and substitutions can be made to the present invention, the presently preferred embodiment of which is described herein, without departing from the spirit and scope of the present invention.

I claim:

1. A method of making an artificial flower comprising the steps of:

providing a sheet of colorful plastic material;

compressing the sheet in one direction;

looping a tie around the middle of the compressed sheet;

tightening the tie to securely hold the compressed plastic sheet at or near the middle; and spreading out the ends of the plastic sheet to form a generally circular flower petal appearance.

2. The method of claim 1 wherein said tie comprises a thin piece of plastic with a one way connector disposed on one end.

3. The method of claim 1, wherein the step of compressing the sheet in one direction further comprises the steps of:

inserting the head of the tie into a slot in a first plate such that the tie is securely and removably retained;

placing the sheet of colorful plastic material between the first plate and a second plate which is connected to the first plate such that the sheet is captured and can slide between the two plates;

advancing the sheet against the tie until the sheet is compressed.

4. An apparatus for making artificial flowers comprising:

a first and second plate means disposed adjacent and parallel to each other and being movable with respect to each other;

a roller means disposed on one of said plate means, said roller means being disposed at least a small distance from an end of said plate means, the roller means abutting the surface of the other of said plate means;

a first slot means disposed in said first plate means and a second slot disposed in said second plate means, said first slot means adapted to securely and removably retain a tie therein, and said second slot means adapted to receive the end of said tie therethrough, said slot means being generally aligned with said roller means.

5. An apparatus for making artificial flowers comprising:

a base member and a plate means disposed adjacent to each other and being movable with respect to each other;

a first slot disposed in said base member and a second slot disposed in said plate means, said first slot adapted to receive a tie means, and said second slot being generally aligned with said first slot;

a paper compressing means, disposed between said base member and said plate means, and inserting into said first and said second slots.

6. The apparatus of claim 5, wherein said first slot further comprises a recessed area adapted to receive a tie.

7. The apparatus of claim 5, further comprising a hook means attached to the plate means for securing in place the head of a tie means.

8. The apparatus of claim 5, wherein the paper compressing block further comprises a concave slot for engaging the tie means.

9. An apparatus for making artificial flowers comprising:

a base member and a transparent plate means disposed adjacent to each other and being movable with respect to each other;

a hook means attached to said plate means for securing in place the head of a tie means;

a first slot disposed in said base member and a second slot disposed in said plate means, said first slot having a recessed area adapted to receive a tie means, and said second slot being generally aligned with said first slot;

a paper compressing means, disposed between said base member and said plate means, and inserting into said first and said second slots, having a concave recessed end for engaging the end of a tie means when it lies in said recessed area.

* * * * *